US009547274B2

(12) United States Patent
Ishimitsu et al.

(10) Patent No.: US 9,547,274 B2
(45) Date of Patent: Jan. 17, 2017

(54) IMAGE FORMING APPARATUS HAVING A SOUND ABSORBER

(71) Applicants: Hiroki Ishimitsu, Kanagawa (JP); Masahiro Ishida, Kanagawa (JP); Naoki Matsuda, Kanagawa (JP); Kohta Takenaka, Kanagawa (JP); Toshihiro Shimada, Tokyo (JP); Wataru Hojo, Tokyo (JP)

(72) Inventors: Hiroki Ishimitsu, Kanagawa (JP); Masahiro Ishida, Kanagawa (JP); Naoki Matsuda, Kanagawa (JP); Kohta Takenaka, Kanagawa (JP); Toshihiro Shimada, Tokyo (JP); Wataru Hojo, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/045,420

(22) Filed: Feb. 17, 2016

(65) Prior Publication Data

US 2016/0161905 A1 Jun. 9, 2016

Related U.S. Application Data

(63) Continuation of application No. 14/803,168, filed on Jul. 20, 2015, now Pat. No. 9,298,155.

(30) Foreign Application Priority Data

Jul. 30, 2014 (JP) ..... 2014-155072
Feb. 27, 2015 (JP) ..... 2015-038543

(51) Int. Cl.
*G03G 15/00* (2006.01)
*G03G 21/16* (2006.01)
(Continued)

(52) U.S. Cl.
CPC ..... *G03G 21/1619* (2013.01); *G03G 21/1633* (2013.01); *G10K 11/002* (2013.01); *G10K 11/172* (2013.01)

(58) Field of Classification Search
CPC ..... G03G 21/1619; G10K 11/002
See application file for complete search history.

(56) References Cited

U.S. PATENT DOCUMENTS 5,508,477 A 4/1996 Kato et al.
2008/0078611 A1* 4/2008 Inoue ..... G06F 1/20 181/206
(Continued)

FOREIGN PATENT DOCUMENTS

JP 2000-235396 A 8/2000
JP 2001-117451 A 4/2001
(Continued)

*Primary Examiner* — G. M. Hyder
(74) *Attorney, Agent, or Firm* — Harness, Dickey & Pierce, P.L.C.

(57) ABSTRACT

According to an aspect of the invention, an image forming apparatus includes an apparatus body, a sound absorbing device utilizing a Helmholtz resonator, and a hinged exterior cover operable to open and close relative to the apparatus body. The hinged exterior cover is a hinged cover configured to pivot about a pivot shaft arranged at a lower end portion of the hinged exterior cover. At least a part of the hinged exterior cover has a multiplex structure made by overlaying a plurality of plate-like members on one another. The sound absorbing device is formed by utilizing space between two plate-like members of the plurality of plate-like members making up the multiplex structure as a cavity of the Helmholtz resonator.

6 Claims, 13 Drawing Sheets

(51) Int. Cl.
*G10K 11/00* (2006.01)
*G10K 11/172* (2006.01)

(56) References Cited

U.S. PATENT DOCUMENTS

| | | | |
|---|---|---|---|
| 2012/0048194 | A1 | 3/2012 | Watanabe et al. |
| 2015/0110517 | A1 | 4/2015 | Ishida et al. |
| 2015/0241838 | A1 | 8/2015 | Ishida et al. |
| 2015/0243274 | A1 | 8/2015 | Hirakawa et al. |

FOREIGN PATENT DOCUMENTS

| | | | |
|---|---|---|---|
| JP | 3816678 | B2 | 8/2006 |
| JP | 2008199692 | A | 8/2008 |
| JP | 2012008458 | A | 1/2012 |
| JP | 2012071662 | A | 4/2012 |

* cited by examiner

IMAGE FORMING APPARATUS HAVING A SOUND ABSORBER

CROSS-REFERENCE TO RELATED APPLICATIONS

This application is a continuation application of and claims priority under 35 U.S.C. §120/121 to U.S. application Ser. No. 14/803,168 filed Jul. 20, 2015, which claims priority to Japanese Patent Application No. 2014-155072 filed in Japan on Jul. 30, 2014 and Japanese Patent Application No. 2015-038543 filed in Japan on Feb. 27, 2015, the entire contents of each of which are hereby incorporated herein by reference.

BACKGROUND OF THE INVENTION

1. Field of the Invention

The present invention relates generally to an image forming apparatus including a sound absorbing device utilizing a Helmholtz resonator.

2. Description of the Related Art

An electrophotographic image forming apparatus typically emits, when forming an image, sounds including operating sounds of various drive units and rotational sound of a polygon mirror. Example configurations for absorbing sounds emitted during image formation are disclosed in Japanese Laid-open Patent Application No. 2000-235396 and Japanese Laid-open Patent Application No. 2001-11745, each disclosing an image forming apparatus including a sound absorbing device utilizing a Helmholtz resonator.

A Helmholtz resonator is made of a cavity having a certain volume and a port portion connecting the cavity to the outside air. Frequency f of sound to be absorbed by a sound absorbing device utilizing a Helmholtz resonator is given by Equation (1) below $$f = \frac{c}{2\pi}\sqrt{\frac{S}{V(H+\Delta r)}} \tag{1}$$

where V is the volume of the cavity, S is opening area of the port portion, H is the length of the port portion in the direction in which sounds come in, c is the speed of sound, and Δr is open end correction.

Some type of image forming apparatuses includes a hinged exterior cover operable to open and close relative to an apparatus body so as to expose a consumable, which can be a toner bottle and/or a process cartridge, when a user replaces the consumable. Such a hinged exterior cover is typically arranged in one side surface, which faces a user operating a control panel of the image forming apparatus, of side surfaces of the image forming apparatus. Accordingly, if sound leaks out of the apparatus from the side surface facing the user, the sound is likely to be perceived as objectionable noise.

One type of such a hinged exterior cover of an image forming apparatus is a double-door hinged cover hinged on the right and left, an example of which is disclosed in Japanese Laid-open Patent Application No. 2000-235396. However, recent image forming apparatuses generally employ a hinged exterior cover of a vertically-pivotable type configured to rotate about a pivot shaft arranged at a lower end portion of the hinged cover from a closed state to an open state in a manner to tilt toward near side (outer side). Such a vertically-pivotable hinged exterior cover is advantageous in that even if an operator who is opening the hinged exterior cover releases his/her hand therefrom, the hinged exterior cover can rotate under its own weight to the open state. However, the hinged exterior cover can be damaged by a shock imparted thereto when, after rotating under its own weight, the hinged exterior cover stops rotating suddenly at a position where the hinged exterior cover is in the open state. For this reason, a hinged exterior cover is required to have greater strength than such a double-door hinged cover as that disclosed in Japanese Laid-open Patent Application No. 2000-235396.

Thus, there is a need for an image forming apparatus capable of reducing leakage of sound from a side surface, in which a vertically-pivotable hinged exterior cover configured to pivot about a pivot shaft arranged at a lower end portion of the hinged exterior cover is provided, of the image forming apparatus while simultaneously increasing strength of the hinged exterior cover.

SUMMARY OF THE INVENTION

It is an object of the present invention to at least partially solve the problems in the conventional technology.

According to the present invention, there is provided an image forming apparatus comprising: an apparatus body; a sound absorbing device utilizing a Helmholtz resonator; and a hinged exterior cover operable to open and close relative to the apparatus body, wherein, the hinged exterior cover is a hinged cover configured to pivot about a pivot shaft arranged at a lower end portion of the hinged exterior cover, at least a part of the hinged exterior cover having a multiplex structure made by overlaying a plurality of plate-like members on one another, and the sound absorbing device is formed by utilizing space between two plate-like members of the plurality of plate-like members making up the multiplex structure as a cavity of the Helmholtz resonator.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

As an image forming apparatus in accordance with an aspect of the present invention, an electrophotographic copier (hereinafter, "copier 500") according to an embodiment of the present invention is described below. Although the copier 500 according to the embodiment is described by way of example of a monochrome image forming apparatus, aspects of the present invention are applicable to known color image forming apparatuses as well.

A configuration of the copier 500 is described below.

Figure 2:
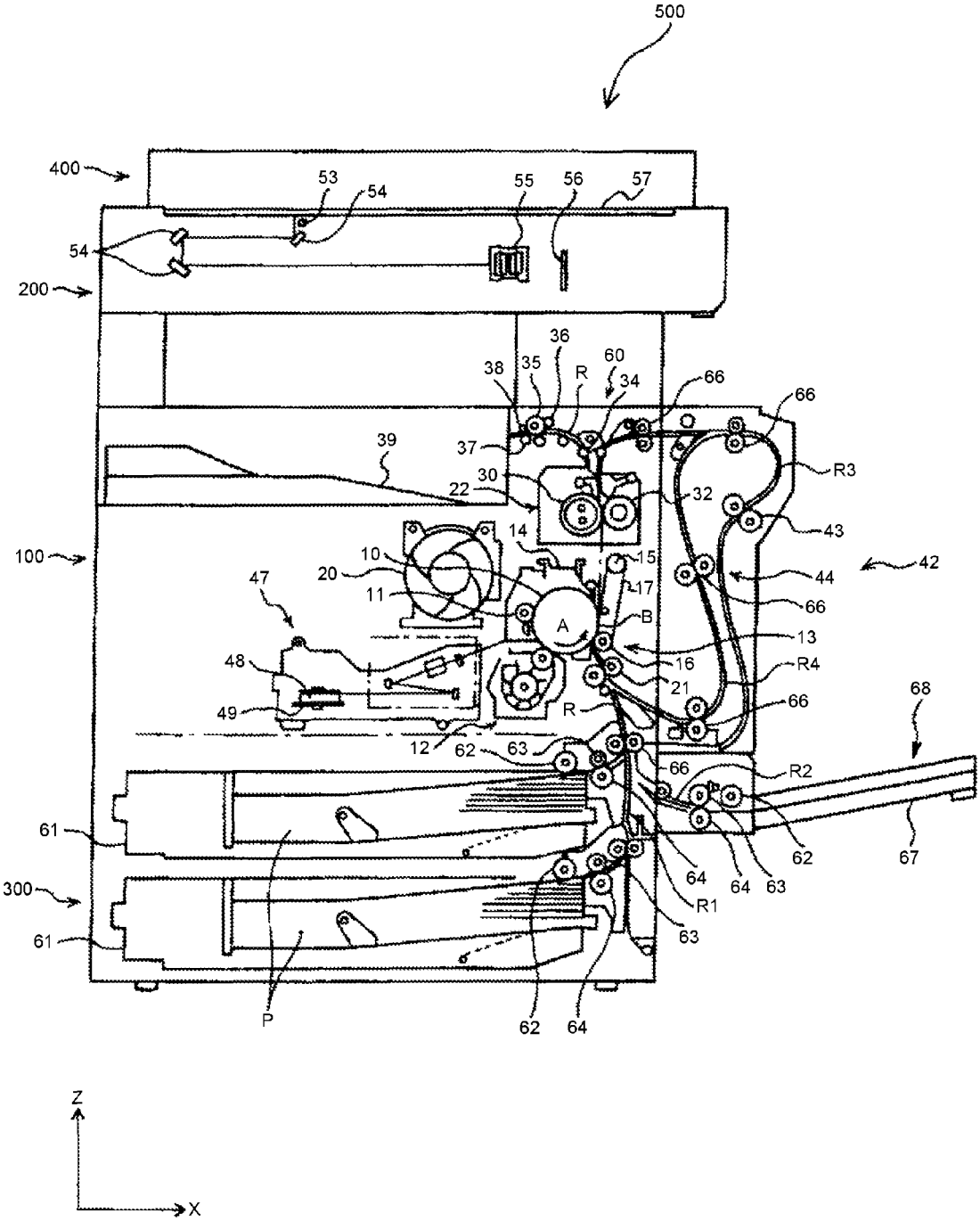
FIG. 2 is a configuration schematic of a copier according to an embodiment of the present invention.

FIG. 2 is a configuration schematic of the overall copier 500 according to the embodiment. Referring to FIG. 2, in the copier 500, an image reading device 200 is mounted on a copier body 100 which is placed on a recording-paper bank 300. An automatic document feeder (ADF) 400 operable to pivot on a pivot formed on the back side (which is on the far side in FIG. 2) is mounted on the image reading device 200.

Figure 3:
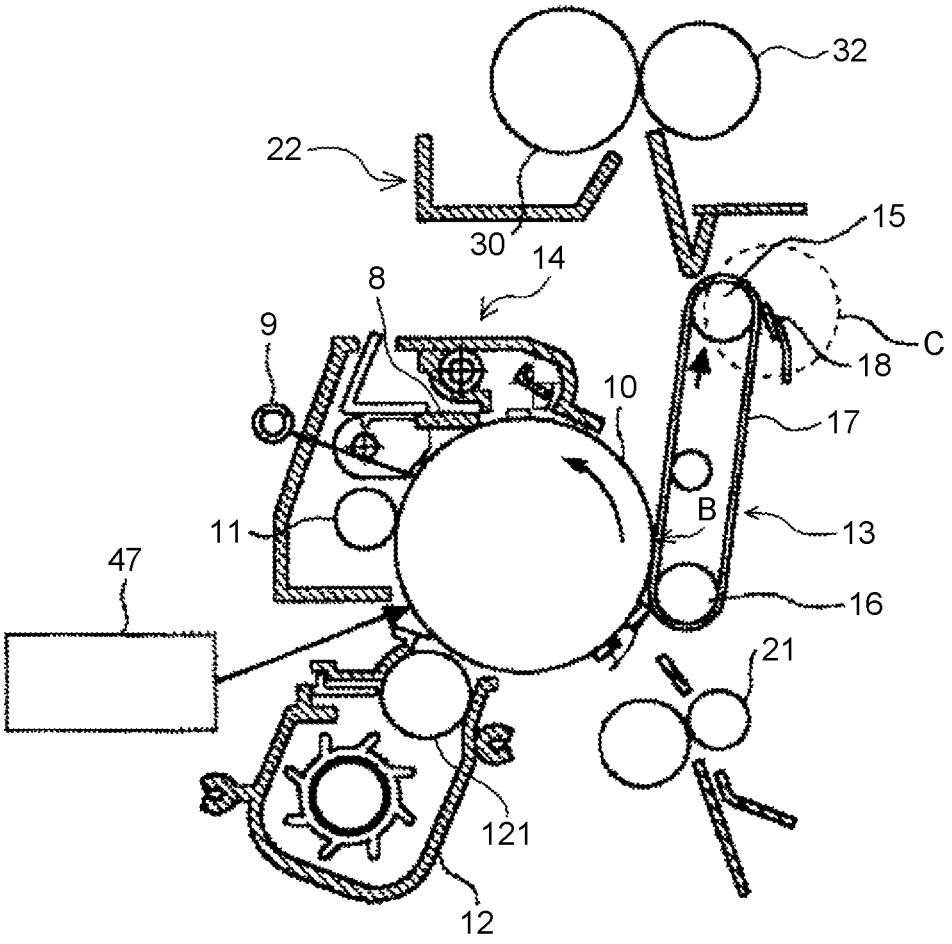
FIG. 3 is a configuration schematic of a photoconductor and nearby elements in the copier illustrated in FIG. 2.

A drum-shaped photoconductor 10 serving as a latent image bearer is disposed inside the copier body 100. FIG. 3 is an enlarged configuration schematic of the photoconductor 10 and nearby elements. As illustrated in FIG. 3, a static neutralizing lamp 9, a charging device 11 utilizing a charging roller, a developing device 12, a transfer unit 13, and a cleaning device 14 including a photoconductor cleaning blade 8 are arranged around the photoconductor 10. The developing device 12 uses polymerization toner prepared by polymerization as toner. The developing device 12 causes the polymerization toner to adhere to an electrostatic latent image on the photoconductor 10 by using a developing roller 121 serving as a developing-agent bearer, thereby converting the electrostatic latent image into a visible image.

The transfer unit 13 includes a first belt-tensioning roller 15, a second belt-tensioning roller 16, and a transfer belt 17 wrapped around these two roller members. The transfer belt 17 is pressed against a peripheral surface of the photoconductor 10 at a transfer position B.

A cleaning blade 18 is arranged in contact with the first belt-tensioning roller 15 with the transfer belt 17 therebetween at a transfer-belt cleaning part C. The cleaning blade 18 scrapes off residual toner and foreign material such as paper powder that are left on the transfer belt 17 from which recording paper P is detached.

The copier body 100 further includes, to the left of the charging device 11 and the cleaning device 14 in FIG. 2, a toner supplying device 20 that supplies new toner to the developing device 12.

The copier body 100 further includes a recording-paper conveying device 60 that conveys the recording paper P delivered from a recording-paper cassette 61 of the recording-paper bank 300 to the transfer position B and eventually to a discharged-paper stacker 39. The recording-paper conveying device 60 conveys the recording paper P along a supply path R1 or a bypass supply path R2, and a recording-paper conveyance path R. A pair of registration rollers 21 is arranged on the recording-paper conveyance path R at a position upstream of the transfer position B in a recording-paper conveying direction.

A thermal fixing device 22 is arranged on the recording-paper conveyance path R at a position downstream of the transfer position B in the recording-paper conveying direction. The thermal fixing device 22 performs pressure-and-heat fixing by pinching the recording paper P between a heating roller 30, which is a heating member, and a pressure-applying roller 32, which is a pressure-applying member.

A paper-discharge-path bifurcating claw 34, a discharging roller 35, a first pressure-applying roller 36, a second pressure-applying roller 37, and a stiffening roller 38 are arranged further downstream of the thermal fixing device 22 in the recording-paper conveying direction. The discharged-paper stacker 39 where image-formed sheets of the recording paper P output from the thermal fixing device 22 are to be stacked is also arranged downstream of the thermal fixing device 22.

A switchback device 42 is arranged on the right side of the copier body 100 in FIG. 2. The switchback device 42 conveys the recording paper P along a sheet-side reversing path R3 forked from the recording-paper conveyance path R at the paper-discharge-path bifurcating claw 34 and along a return path R4 that delivers the recording paper P having been conveyed along the sheet-side reversing path R3 back to the pair of registration rollers 21 on the recording-paper conveyance path R. A pair of switchback rollers 43 is arranged on the sheet-side reversing path R3. A plurality of pairs of recording-paper conveying rollers 66 are arranged on the return path R4.

As illustrated in FIG. 2, a laser writing device 47 is arranged to the left of the developing device 12 in FIG. 2 in the copier body 100. The laser writing device 47 includes a laser light source and a scanning optical system including a polygon mirror 48, which is a rotating multi-facet mirror for use in scanning, a polygon motor 49, and an fθ lens.

The image reading device 200 includes a light source 53, a plurality of mirrors 54, an imaging forming optical lens 55, and an image sensor 56 such as a CCD (charge-coupled device) image sensor. The image reading device 200 includes, on its top surface, an exposure glass 57.

The ADF 400 includes a document table and a document stacking table. The document stacking table is arranged at a position where an original document(s) (hereinafter, "document") is to be discharged. The ADF 400 includes a plurality of document conveying rollers that conveys a document from the document table to a reading position on the exposure glass 57 of the image reading device 200 and eventually to the document stacking table.

The recording-paper bank 300 includes a plurality of the recording-paper cassettes 61, each for storing the recording paper P, which are stacked on each other. The recording paper P is a recording medium such as paper or overhead transparency. Each of the recording-paper cassettes 61 includes a pickup roller 62, a supply roller 63, and a separation roller 64. The supply path R1 described above extending to the recording-paper conveyance path R of the copier body 100 is formed to the right of the recording-paper cassettes 61 in FIG. 2. A plurality of pairs of the recording-paper conveying rollers 66 is arranged on the supply path R1.

A bypass paper-feeding unit 68 is arranged to the right of the copier body 100 in FIG. 2. The bypass paper-feeding unit 68 includes a bypass tray 67 operable to open and close relative to the copier body 100. The above-described bypass supply path R2 which delivers the recording paper P loaded on the bypass tray 67 to the recording-paper conveyance path R is formed in the bypass paper-feeding unit 68. The bypass paper-feeding unit 68 also includes, as does the recording-paper cassette 61, the pickup roller 62, the supply roller 63, and the separation roller 64.

How the copier 500 operates is described below.

To make a copy using the copier 500, first, a user turns "on" a main switch and places a document on the document table of the ADF 400. When making a copy of a document, such as a book, that cannot be fed using the ADF 400, a user opens the ADF 400, places the document directly on the exposure glass 57 of the image reading device 200, and closes and presses the ADF 400 against the document.

When a start switch is pressed with a document placed in the ADF 400, the image reading device 200 is driven after the document has been moved onto the exposure glass 57 by a document conveying roller (not illustrated) along a document conveyance path (not illustrated). After an image of the document is read, the document is discharged onto the document stacking table.

On the other hand, when a document is placed directly on the exposure glass 57, the image reading device 200 is driven to read an image of the document immediately after the start switch is pressed.

The document image is read in the following manner. The image reading device 200 irradiates a surface of the document on the exposure glass 57 with light from the light source 53 while moving the light source 53 along the exposure glass 57. The image reading device 200 guides light reflected off the document using the plurality of mirrors 54 to the imaging forming optical lens 55 so that the reflected light enters the image sensor 56, whereby the document image is read.

In the copier 500, the photoconductor 10 is rotated by a photoconductor drive motor simultaneously with document image reading. The charging device 11 charges the surface of the photoconductor 10 to, for example, approximately −1,000 volts. Thereafter, the copier 500 forms an electrostatic latent image on the surface of the photoconductor 10 by performing laser writing by causing the laser writing device 47 to irradiate the photoconductor 10 with laser light in accordance with the document image read by the image reading device 200. The surface potential at a portion (latent image portion) irradiated with the laser light increases to, for example, 0 to −200 volts. Thereafter, the developing device 12 causes toner to adhere to the electrostatic latent image, thereby converting the electrostatic latent image into a visible image.

In the copier 500, immediately when the start switch is pressed, the recording paper P is delivered by the pickup roller 62 from one, which stores the recording paper P of a selected size, of the plurality of recording-paper cassettes 61 included in the recording-paper bank 300. The supply roller 63 and the separation roller 64 separate one sheet of the delivered recording paper P from the other sheets and deliver the one sheet to the supply path R1, where the one sheet is delivered by a pair of the recording-paper conveying rollers 66 to the recording-paper conveyance path R. The recording paper P conveyed to the recording-paper conveyance path R is stopped by abutting against the pair of registration rollers 21.

When feeding the recording paper P using the bypass paper-feeding unit 68, the bypass tray 67 is opened to place the recording paper P thereon. Also in this case, the pickup roller 62, the supply roller 63, and the separation roller 64 convey only one sheet of the recording paper P placed on the bypass tray 67 to the bypass supply path R2, where the one sheet is delivered by a pair of the recording-paper conveying rollers 66 to the recording-paper conveyance path R. The recording paper P delivered to the recording-paper conveyance path R is stopped by abutting against the pair of registration rollers 21.

The recording paper P stopped by the pair of registration rollers 21 in this manner is delivered to the transfer position B by the pair of registration rollers 21 that starts rotating concurrently when the leading end of the toner image, which is the visible image obtained by developing the electrostatic latent image, on the photoconductor 10 advances to the transfer position B.

The toner image on the photoconductor 10 is transferred by the transfer unit 13 onto the recording paper P delivered to the transfer position B. Hence, the recording paper P bears the toner image on its surface. The cleaning device 14 removes residual toner left on the surface of the photoconductor 10 from which the toner image is transferred. Furthermore, the static neutralizing lamp 9 removes residual charges from the photoconductor 10. The surface, from which the residual charges are removed, has uniform potential of from −150 to 0 volts and is ready for a next image forming job that begins at the charging device 11.

Meanwhile, the recording paper P bearing the toner image is conveyed by the transfer belt 17 into the thermal fixing device 22. Heat and pressure applied to the recording paper P during when the recording paper P is conveyed between the heating roller 30 and the pressure-applying roller 32 fix the toner image onto the recording paper P. Thereafter, the recording paper P is stiffened and discharged by the discharging roller 35, the first pressure-applying roller 36, the second pressure-applying roller 37, and the stiffening roller 38 into the discharged-paper stacker 39 to be stacked therein.

When forming images on both sides of the recording paper P, the paper-discharge-path bifurcating claw 34 is switched so that, after a toner image is transferred and fixed onto one surface of the recording paper P, the recording paper P is conveyed from the recording-paper conveyance path R to the sheet-side reversing path R3. The recording paper P conveyed to the sheet-side reversing path R3 is conveyed by a pair of the recording-paper conveying rollers 66 to a switchback position 44. Thereafter, the recording paper P is switched back by the pair of switchback rollers 43 onto the return path R4 and conveyed by pairs of the recording-paper conveying rollers 66 to return to the recording-paper conveyance path R. A toner image is transferred in a manner similar to that described above onto the other surface of the recording paper P passed through the return path R4.

Figure 4:
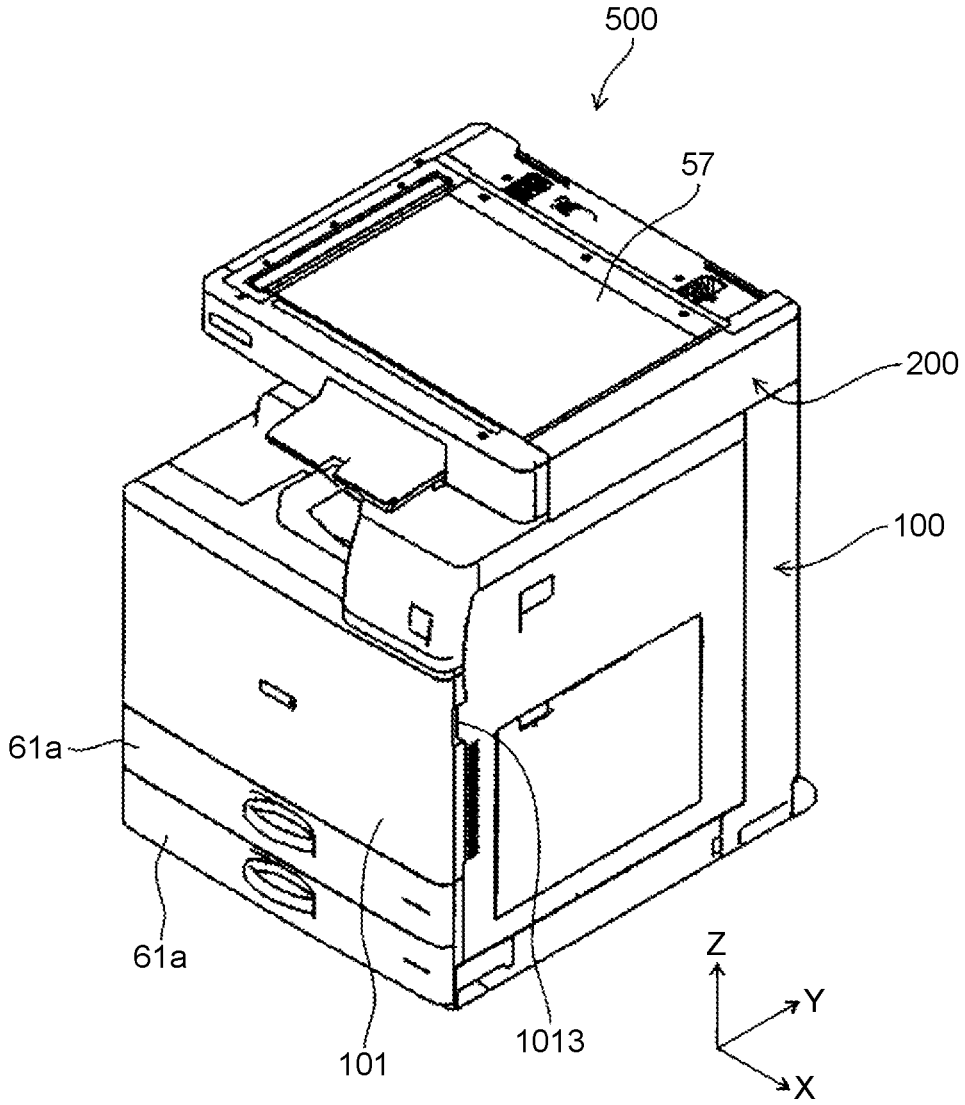
FIG. 4 is a perspective explanatory view of the copier illustrated in FIG. 2.
Figure 5:
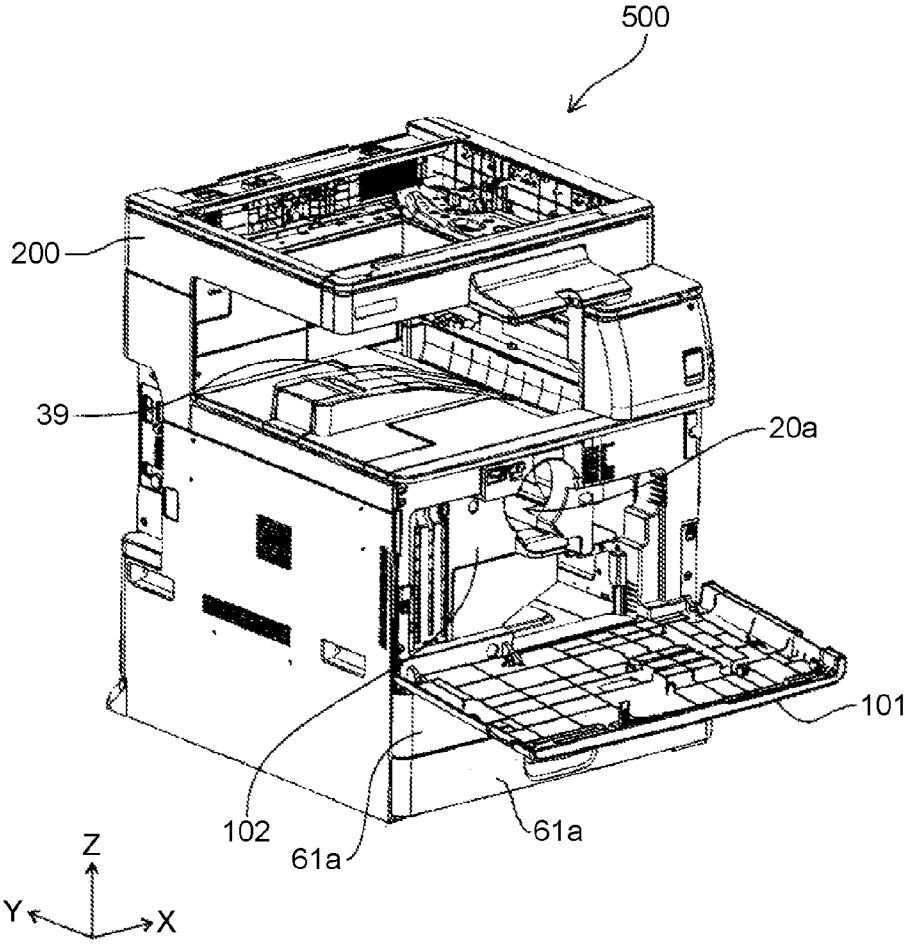
FIG. 5 is a perspective explanatory view of the copier illustrated in FIG. 2 with its hinged front cover open.

FIG. 4 is a perspective explanatory view of the copier 500 with the ADF 400 removed therefrom. FIG. 5 is a perspective explanatory view of the copier 500 with its hinged front cover 101 open. FIG. 5 illustrates the copier 500 with the ADF 400 and the optical system, which is inside the image reading device 200, removed therefrom. The copier 500 includes the hinged front cover 101, which is a part of an exterior cover, operable to open and close. The hinged front cover 101 is to be opened at replacement of a toner bottle or maintenance.

With the hinged front cover 101 open, an inner front cover 102, which is an interior cover, is exposed. The copier 500 illustrated in FIG. 5 is in a state where the toner bottle included in the toner supplying device 20 is removed therefrom and a bottle mount hole 20*a*, to which the toner bottle is to be inserted, in the inner front cover 102 is in open (empty) state. Recording-paper-cassette exterior covers 61*a* each including a handle for use in drawing out the recording-paper cassette 61 are arranged below the hinged front cover 101 of the copier 500.

Sound emitted by electronic equipment such as an image forming apparatus in operation can be perceived as objectionable noise by nearby people. Known countermeasures against such noise emitted from electronic equipment include use of Helmholtz resonators that absorb specific frequency sounds.

In the copier 500 according to the embodiment, the hinged front cover 101 includes a sound absorbing device 600 utilizing Helmholtz resonators.

Figure 6:
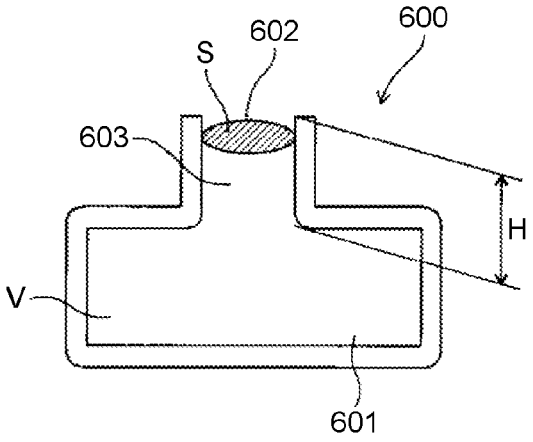
FIG. 6 is a schematic diagram of a sound absorbing device utilizing a Helmholtz resonator.

FIG. 6 is a schematic diagram of the sound absorbing device 600 utilizing the Helmholtz resonators.

As illustrated in FIG. 6, the Helmholtz resonator is shaped like a container having a narrow inlet and includes a cavity 601 having a volume of a certain size and a port portion 603 smaller than the cavity 601. The Helmholtz resonator absorbs specific frequency sound coming through the port portion 603.

Frequency f of sound to be absorbed by the sound absorbing device 600 is given by Equation (1) below $$f = \frac{c}{2\pi}\sqrt{\frac{S}{V(H+\Delta r)}} \tag{1}$$

where V is the volume of the cavity 601, S is the opening area of an opening 602 of the port portion 603, H is the length of the port portion 603, and c is the speed of sound.

In Equation (1), $\Delta r$ is open end correction which may generally be given by: $\Delta r=0.6r$, where r is the radius of cross section of the port portion 603 having a circular cross section.

As indicated by Equation (1), the frequency of sound to be absorbed by the sound absorbing device 600 can be obtained from the volume V of the cavity 601, the length H of the port portion 603, and the opening area S of the port portion 603.

The copier 500 emits various sounds including operating sounds of drive motors that transmit rotations to the rollers, sounds caused by movements of moving members such as the rollers, and rotational sound of the polygon mirror 48 of the laser writing device 47. If transmitted to the outside of the copier 500, such sound can be perceived as objectionable noise by nearby people. However, the sound absorbing device 600 can be tuned so as to absorb a sound frequency, external transmission of which is desirably prevented, so that the sound absorbing device 600 can absorb sound which can possibly be a noise.

First Implementation Example

A first implementation example of the copier 500 according to an aspect of the present invention is described below.

Figure 1:
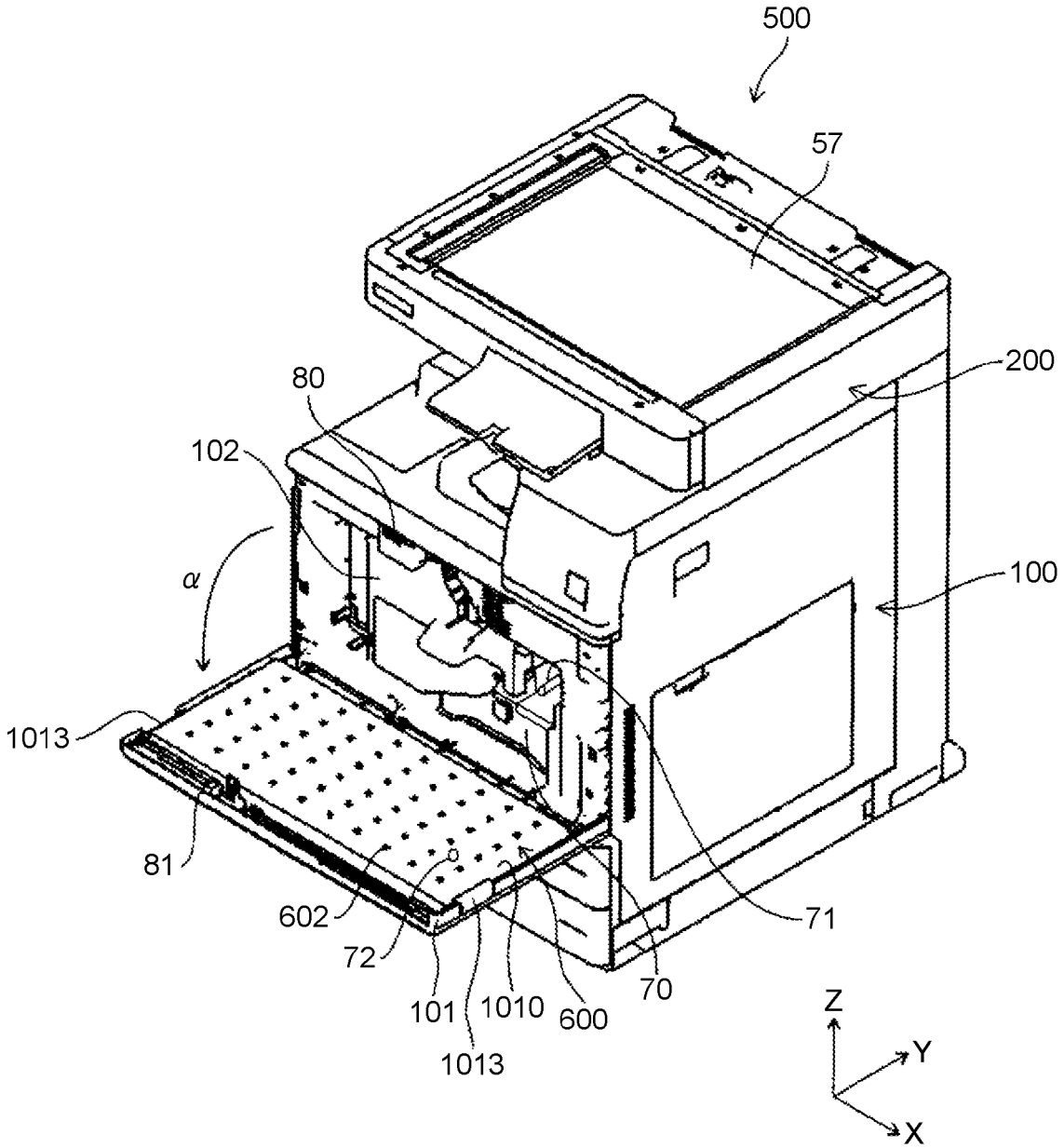
FIG. 1 is a perspective explanatory view of a copier of a first implementation example with its hinged front cover open.
Figure 7:
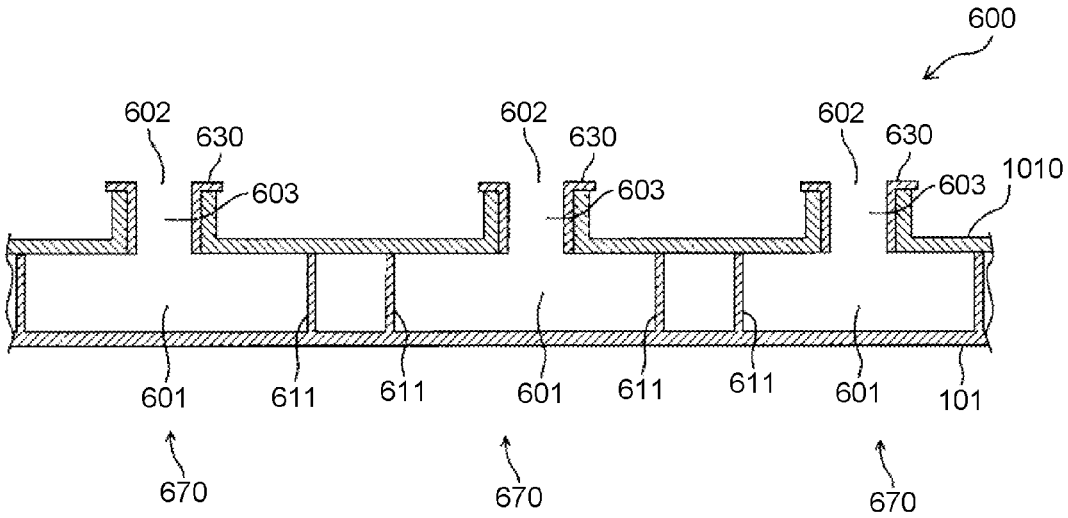
FIG. 7 is a cross-sectional explanatory view of the hinged front cover of the copier of the first implementation example.

FIG. 1 is a perspective explanatory view of the copier 500 of the first implementation example with the hinged front cover 101 open. FIG. 7 is a cross-sectional explanatory view of the hinged front cover 101 of the copier 500 of the first implementation example.

As illustrated in FIGS. 1 and 7, the hinged front cover 101 is constructed by assembling a hinged-cover inner-wall member 1010 having an inner surface, where the port portions 603 are formed, to the hinged front cover 101. A plurality of the cavities 601 are formed between the two members (the hinged front cover 101 and the hinged-cover inner-wall member 1010), thereby forming the sound absorbing device 600 including a plurality of Helmholtz resonators 670. In the sound absorbing device 600 of the first implementation example, as illustrated in FIG. 7, distal ends of ribs 611 formed on the hinged front cover 101 abut against a flat portion of the plate-like hinged-cover inner-wall member 1010. Hence, the cavities 601 enclosed by the hinged front cover 101, the flat portion of the hinged-cover inner-wall member 1010, and side surfaces of the ribs 611 are formed.

As illustrated in FIG. 7, the sound absorbing device 600 of the first implementation example includes sound-absorbing inner sleeves 630 in the port portions 603 of the hinged-cover inner-wall member 1010. The hinged-cover inner-wall member 1010 that forms wall surfaces of the port portions 603 of the cavities 601 and the sound-absorbing inner sleeves 630 that determine the opening area and the length of the port portions 603 are separate members. Accordingly, the length H of the port portion 603 and the opening area S of the port portion 603 involved in Equation (1) can be changed easily by changing the sound-absorbing inner sleeves 630 to those of different shape. This means that the sound absorption frequency can be changed easily and inexpensively.

The hinged front cover 101 of the copier 500 is a hinged cover of "vertically-pivotable type" mounted at its lower end portion on the copier body 100 with a hinge and to be opened and closed by being tilted toward the front (outside). The hinged front cover 101 is operable to rotate about a pivot shaft of the hinge from the closed state illustrated in FIG. 4 to the open state illustrated in FIG. 5 and other drawings in a manner to tilt toward the front. A magnetic member 81 is secured to the hinged front cover 101 at a position near the upper end of the hinged front cover 101. A magnet 80 is arranged on the copier body 100 at a position facing the magnetic member 81 when the hinged front cover 101 is closed. As illustrated in FIG. 4, with the hinged front cover 101 closed, the magnet 80 on the copier body 100 attracts the magnetic member 81 on the hinged front cover 101 to thereby secure the upper end of the hinged front cover 101 to the copier body 100, thereby maintaining the closed state.

As illustrated in FIG. 4, a handle 1013 is arranged on a side end portion of the hinged front cover 101. When the hinged front cover 101 is pulled out by a user or a maintenance person (hereinafter, "operator") to replace a consumable or perform maintenance by holding the handle 1013, the magnetic member 81 on the hinged front cover 101 is separated from the magnet 80, releasing the hinged front cover 101 which is secured at its upper end from the copier body 100. The hinged front cover 101, which is thus released from being secured at its upper end, is pivoted about the hinge as indicated by arrow a in FIG. 1 under its own weight or by being pulled by the operator into the open state.

The hinged front cover 101 is a hinged cover of the vertically-pivotable type configured to pivot about its lower end portion. When an operator who is opening the hinged front cover 101 releases his/her hand therefrom, the hinged front cover 101 is pivoted under its own weight as indicated by the arrow a in FIG. 1 and stopped in the open state illustrated in FIG. 1. When the hinged front cover 101 is pivoted under its own weight, the hinged front cover 101 can be damaged by a shock caused by sudden stop at the open position if the strength of the hinged front cover 101 is insufficient.

A hinged front cover of a double-door type hinged on the right and left is disclosed in Japanese Laid-open Patent Application No. 2000-235396. Such a double-door hinged cover is advantageous in that, even if an operator who is opening the double-door hinged cover releases his/her hand therefrom, the hinged cover will not rotate in the opening direction under its own weight. Because little shock is imparted to the hinged cover during when the hinged cover is opened, the strength required of the double-door hinged cover is lower than that of the vertically-pivotable hinged cover. However, a double-door hinged cover requires two cover members and two hinges, one for each of the two members. This can lead to increases in the number of components and cost.

By contrast, such a vertically-pivotable hinged cover as the hinged front cover 101 of the first implementation example can advantageously reduce increases in the number of components and cost.

The hinged front cover 101 of the copier 500 of the first implementation example has a double structure made up of two plate-like members constructed by assembling the hinged-cover inner-wall member 1010 onto the hinged front cover 101. Because the hinged front cover 101, which is a single plate-like member, is supported by the hinged-cover inner-wall member 1010, the hinged front cover 101 is increased in strength as compared with a configuration in which the hinged front cover 101 is made of only a single resin member.

Accordingly, even if a shock is imparted to the hinged front cover 101 when the hinged front cover 101 is opened, the hinged front cover 101 is less likely damaged by the shock.

If the structure which forms the sound absorbing device 600 and the structure for increasing the strength of the hinged front cover 101 were independent of each other, the number of components and apparatus size can disadvantageously increase. However, the copier 500 of the first implementation example has the structure in which the hinged-cover inner-wall member 1010 is assembled to the hinged front cover 101, and the sound absorbing device 600 is formed by utilizing space between the hinged-cover inner-wall member 1010 and the hinged front cover 101 as the cavities 601. In short, the sound absorbing device 600 is formed by making use of the structure for increasing the strength of the hinged front cover 101. Accordingly, this structure allows providing the sound absorbing device 600 for absorbing sound which can possibly be a noise and increasing the strength of the hinged front cover 101 while reducing increases in the number of components and apparatus size.

Figure 8:
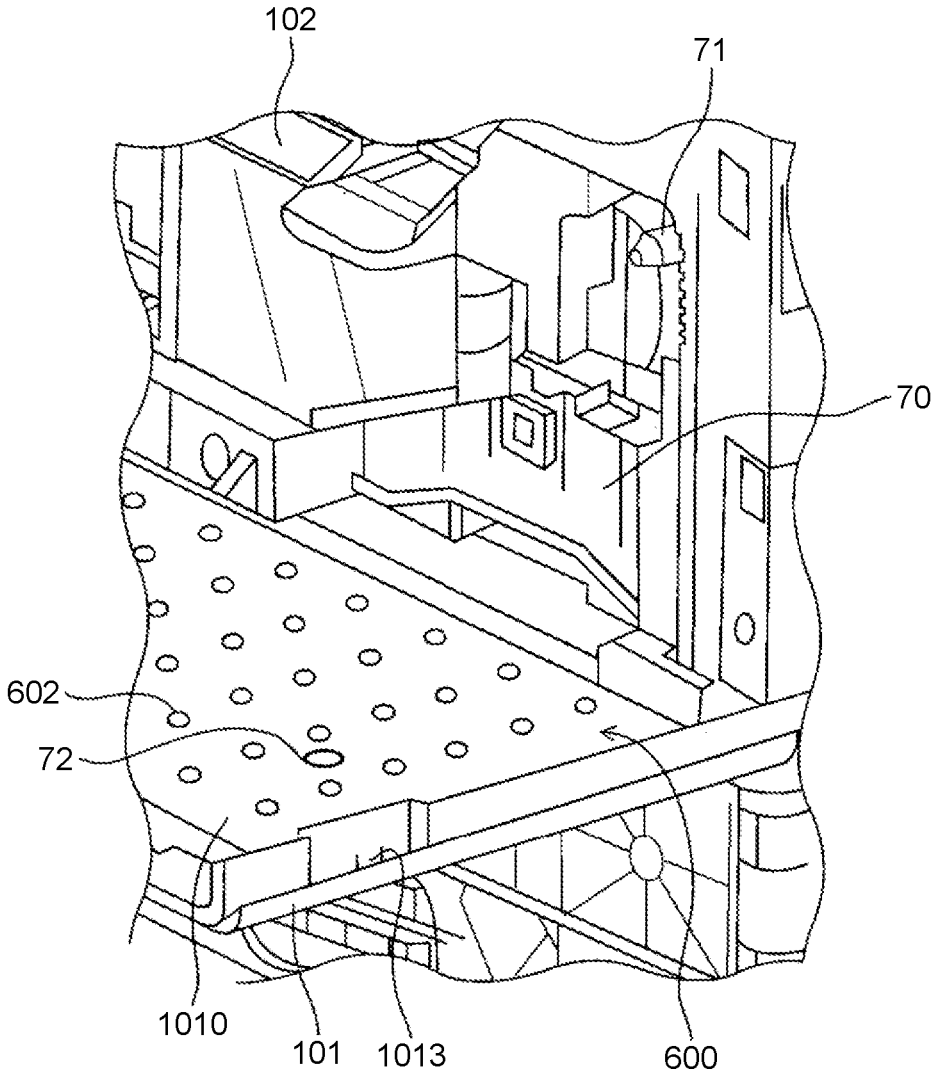
FIG. 8 is an enlarged perspective view of a positioning pin, a positioning hole, and nearby elements of the copier of the first implementation example.

FIG. 8 is an enlarged perspective view of a positioning pin 71 and a positioning hole 72 illustrated in FIG. 1 and nearby elements. As illustrated in FIGS. 1 and 8, the copier 500 includes the positioning pin 71 on the copier body 100 and has the positioning hole 72 in the hinged-cover inner-wall member 1010. The copier 500 is configured such that closing the hinged front cover 101 causes the positioning pin 71 to be inserted to the positioning hole 72, thereby positioning the hinged front cover 101 relative to the copier body 100.

A Helmholtz resonator generally absorbs sound more efficiently as the distance from a source of sound of a to-be-absorbed frequency decreases. Furthermore, with sound reflection and the like taken into account, sound-absorbing effect of a Helmholtz resonator varies depending not only on the distance from a sound source but also on the position of a port portion of the Helmholtz resonator relative to the sound source.

For these reasons, it is desirable to locate the sound absorbing device 600 at a position, relative to a sound source, that maximizes the sound-absorbing effect.

However, an exterior cover operable to open and close relative to the copier body 100 as is the hinged front cover 101 is secured more loosely than an exterior cover that is fixed with a screw or the like. Accordingly, the position of the hinged front cover 101 relative to the copier body 100 is prone to variation induced by operational vibrations of the copier 500. For this reason, a structure in which the sound absorbing device 600 is arranged in the hinged front cover 101 as in the first implementation example can have a disadvantage. That is, even if the sound absorbing device 600 is located at a position that maximizes the sound-absorbing effect in design, the hinged front cover 101 can be displaced by vibrations, resulting in a failure to obtain the desired sound-absorbing effect.

However, the copier 500 of the first implementation example is configured such that the positioning pin 71 and the positioning hole 72 position the hinged front cover 101 relative to the copier body 100 as illustrated in FIGS. 1 and 8. This configuration can reduce, even if the sound absorbing device 600 is arranged in the hinged front cover 101 being an exterior cover that is secured more loosely than a fixed exterior cover, displacement of the sound absorbing device 600 relative to a sound source caused by vibrations of the hinged front cover 101 induced by vibrations inside and/or outside the copier 500. Because displacement of the sound absorbing device 600 is reduced, the sound absorbing device 600 can be fixed at a desired position relative to the sound source. As a result, a desired sound-absorbing effect can be obtained.

Figure 9:
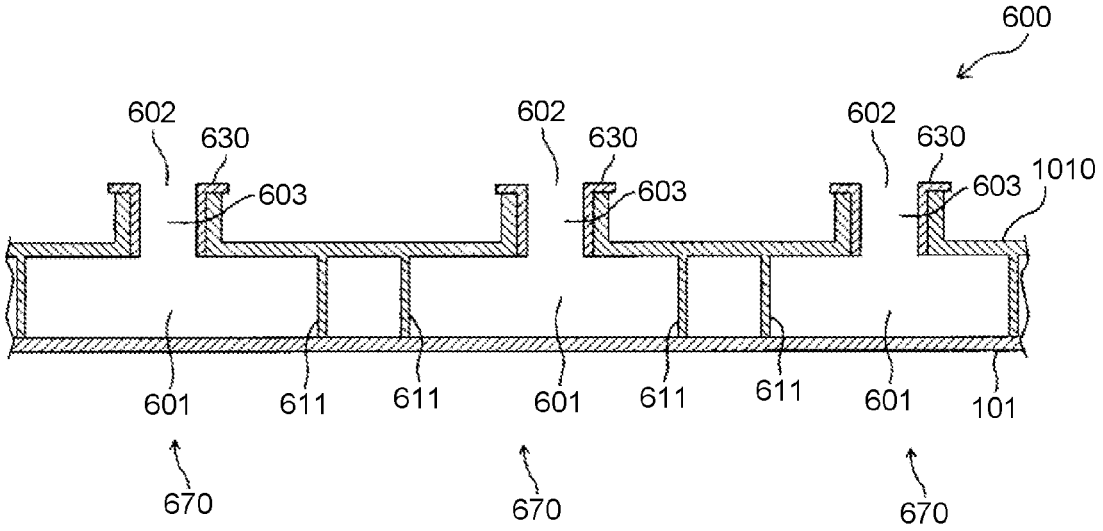
FIG. 9 is a cross-sectional explanatory view of the hinged front cover of the first implementation example where ribs are formed on a hinged-cover inner-wall member.

As illustrated in FIG. 7, in the copier 500 of the first implementation example, the ribs 611 are formed on the inner flat portion of the hinged front cover 101 in a manner to project from the flat portion to the hinged-cover inner-wall member 1010. The ribs 611 providing the side surfaces of the cavities 601 may alternatively be formed on the hinged-cover inner-wall member 1010 in a manner to project from the flat portion of the hinged-cover inner-wall member 1010 to the hinged front cover 101 as illustrated in FIG. 9.

Second Implementation Example

A second implementation example of the copier 500 according to an aspect of the present invention is described below.

Figure 10:
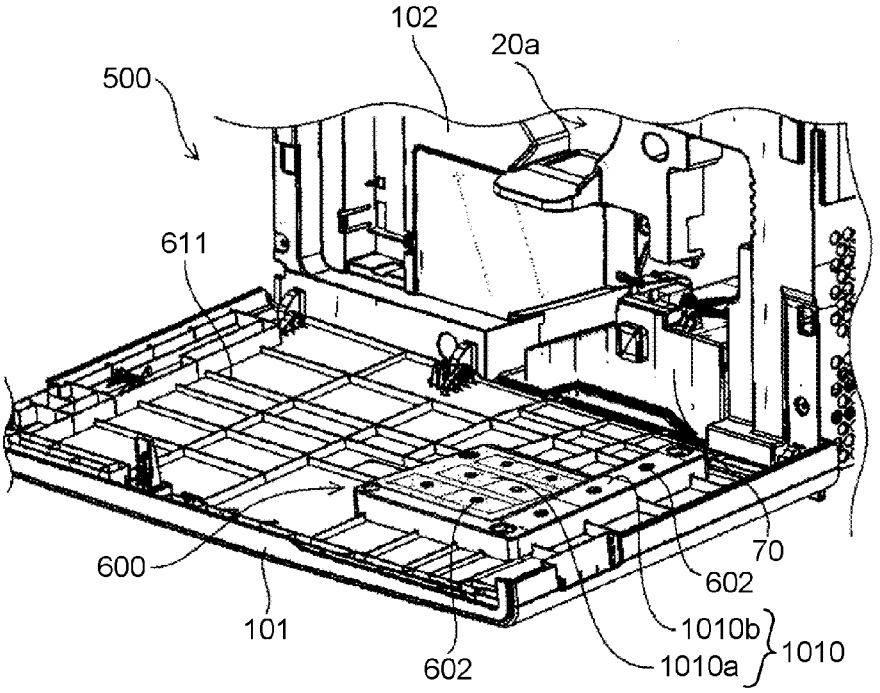
FIG. 10 is an enlarged perspective explanatory view of the hinged front cover that is open and nearby elements of the copier of a second implementation example.
Figure 11:
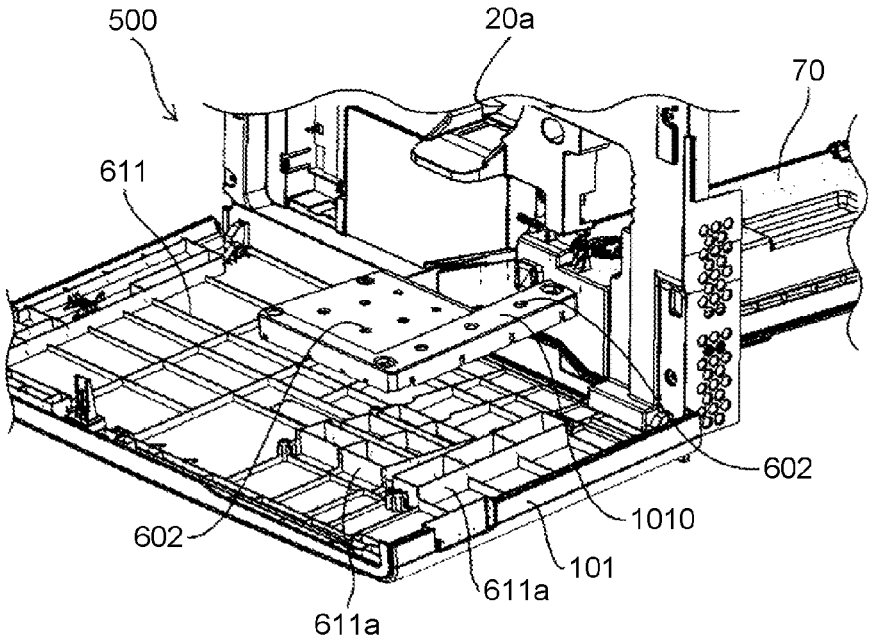
FIG. 11 is a perspective explanatory view of the hinged front cover illustrated in FIG. 10 with its hinged-cover inner-wall member removed therefrom.

FIG. 10 is an enlarged perspective explanatory view of the hinged front cover 101 being in open state and nearby elements of the copier 500 of the second implementation example. FIG. 11 is a perspective explanatory view of the hinged front cover 101 illustrated in FIG. 10 with the hinged-cover inner-wall member 1010 removed therefrom.

The copier 500 of the first implementation example illustrated in FIG. 1 is configured such that the hinged-cover inner-wall member 1010 covers the entire inner surface of the hinged front cover 101. By contrast, the copier 500 of the second implementation example is configured such that the hinged-cover inner-wall member 1010 covers only a part of the inner surface of the hinged front cover 101 as illustrated in FIG. 10. The hinged-cover inner-wall member 1010 includes a reduced portion 1010*a* and a guide portion 1010*b* that differ from each other in height of top surfaces thereof in an orientation where the hinged front cover 101 is open.

As illustrated in FIG. 11 where the hinged-cover inner-wall member 1010 serving as a lid of the Helmholtz resonators 670 is lifted, some ribs among the ribs 611 reinforcing the hinged front cover 101 are formed as cavity-forming ribs 611*a* that form wall surfaces of the cavities 601 of the Helmholtz resonators 670. Utilizing a part of the hinged front cover 101 as a part of the Helmholtz resonator 670 allows space saving as compared with a configuration where the hinged front cover 101 and the Helmholtz resonator are separate members.

Figure 12:
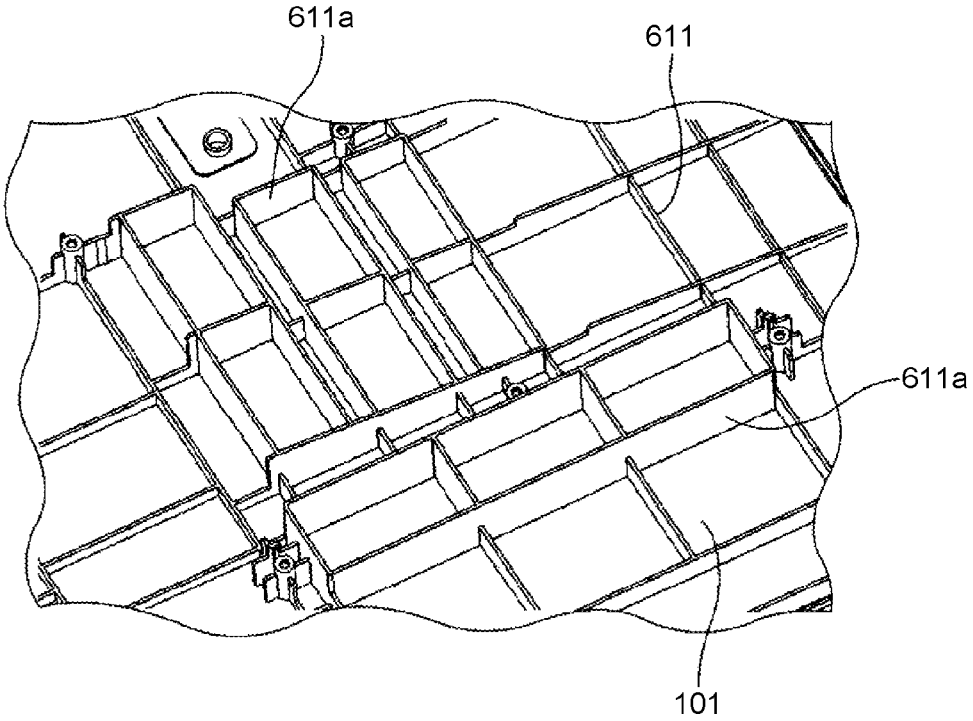
FIG. 12 is an enlarged perspective view of a portion, where cavity-forming ribs are formed, of the hinged front cover illustrated in FIG. 11.

FIG. 12 is an enlarged perspective view of a portion, where the cavity-forming ribs 611*a* are formed, of the hinged front cover 101 illustrated in FIG. 11. As illustrated in FIG. 12, the cavity-forming ribs 611*a*, which are a part of the ribs 611, are higher in height from the flat portion of the hinged front cover 101 than the other portion of the ribs 611 so that the cavity-forming ribs 611*a* function also as the wall surfaces of the cavities 601 of the Helmholtz resonators 670.

Figure 13:
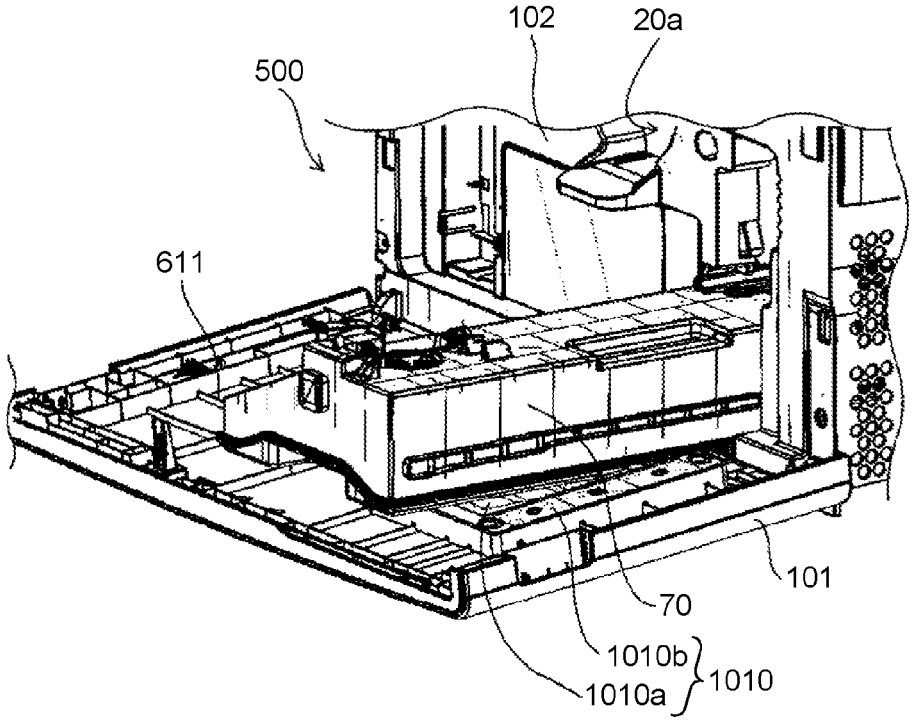
FIG. 13 is a perspective explanatory view of the copier illustrated in FIG. 10 with a waste toner bottle pulled out therefrom.
Figure 14:
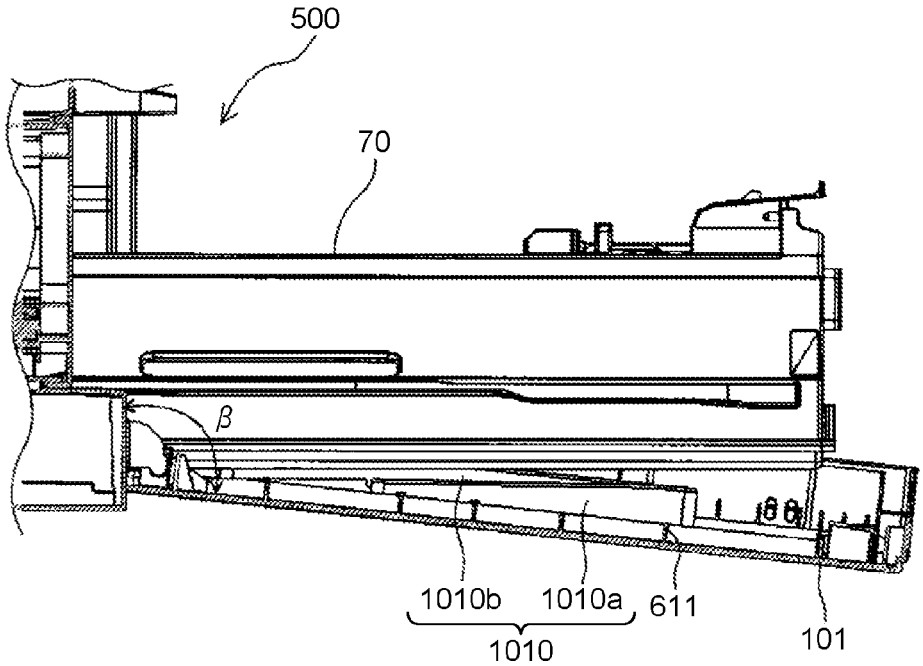
FIG. 14 is a cross-sectional side view of the copier illustrated in FIG. 13 as viewed from the left side of the copier.

FIG. 13 is a perspective explanatory view of the copier 500 illustrated in FIG. 10 with a waste toner bottle 70 pulled out therefrom. FIG. 14 is a cross-sectional side view of the copier 500 illustrated in FIG. 13 as viewed from the left side of the copier 500.

In the copier 500 of the second implementation example, the sound absorbing device 600, which utilizes the Helmholtz resonators, can be mounted directly (integrally) on the hinged front cover 101, thereby achieving space saving.

However, the hinged front cover 101 is to be opened when mounting/dismounting a detachable component, which can be various units, at replacement of a consumable. Accordingly, with the structure in which the sound absorbing device 600 is mounted on the inner surface of the hinged front cover 101, interference between the sound absorbing device 600 and the detachable component can occur when the detachable component is inserted/extracted with the hinged front cover 101 open.

To avoid the interference, in the second implementation example, the hinged-cover inner-wall member 1010 includes the reduced portion 1010*a* which is a portion whose height is lower than that of the other portion as illustrated in FIG. 10 and the other drawings so that the hinged-cover inner-wall member 1010 does not extend through a space across which the waste toner bottle 70, which is a detachable component, is to be inserted/extracted.

As illustrated in FIG. 14, in the copier 500 of the second implementation example, an open angle β in the state where the hinged front cover 101 is opened from the closed state to the open state is slightly larger than 90 degrees. Accordingly, with the hinged front cover 101 open, the flat portion of the hinged front cover 101 is tilted such that its free end (the top end in the closed state) is lower than the horizontal position as illustrated in FIG. 14.

The height from the flat portion of the hinged front cover 101 to the top surface of the reduced portion 1010*a* with the hinged front cover 101 open decreases toward the basal end (on the side of the hinge which is on the side opposite from the free end) of the hinged front cover 101. With the hinged front cover 101 being open, the top surface of the reduced portion 1010*a* is substantially horizontal.

The reduced portion 1010*a* prevents the hinged-cover inner-wall member 1010 from extending through the space across which the waste toner bottle 70 is to be inserted/extracted. As a result, interference between the sound absorbing device 600 and the waste toner bottle 70 can be prevented.

As illustrated in FIG. 10 and other drawings, the hinged-cover inner-wall member 1010 includes the guide portion 1010*b* that forms a step between itself and the reduced portion 1010*a*. With the hinged front cover 101 being open, the top surface of the guide portion 1010*b* extends substantially parallel to the flat portion of the hinged front cover 101. A side surface of the guide portion 1010*b* in a portion where the step is formed between the guide portion 1010*b* and the reduced portion 1010*a* extends in the Y direction (see FIG. 5, for example) (the lateral direction in FIG. 14) which is the front-back direction of the copier 500. Hence, the waste toner bottle 70 can be moved in the Y direction by inserting/extracting the waste toner bottle 70 while making sliding contact between a side surface of the waste toner bottle 70 and the above-described side surface of the guide portion 1010*b*. As a result, operator's work of inserting/extracting the waste toner bottle 70 relative to the copier 500 is facilitated. Thus, the guide portion 1010*b* provides the function of guiding the waste toner bottle 70 in the insertion/extraction direction when mounting/dismounting the waste toner bottle 70.

Figure 15:
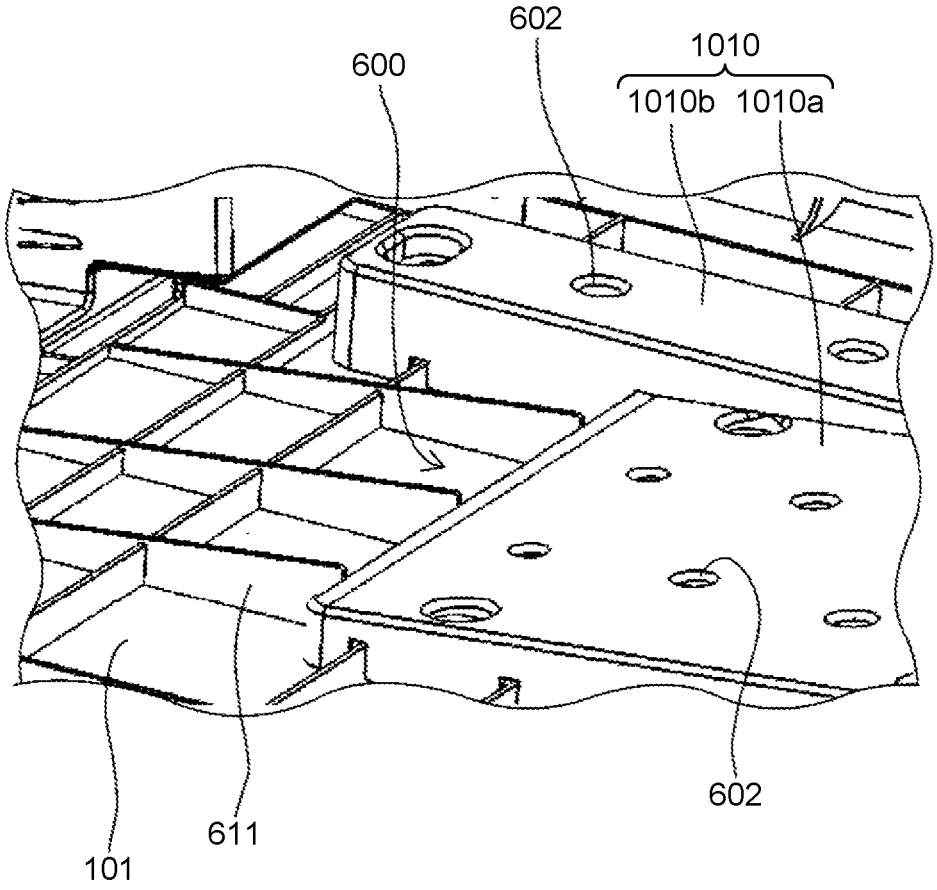
FIG. 15 is an enlarged perspective view of a portion, where the hinged-cover inner-wall member is arranged, of the hinged front cover of the second implementation example.

FIG. 15 is an enlarged perspective view of a portion, where the hinged-cover inner-wall member 1010 is arranged, of the hinged front cover 101 of the copier 500 of the second implementation example. As illustrated in FIG. 15, the ribs 611 formed on the basal side, relative to the hinged-cover inner-wall member 1010, of the hinged front cover 101 are shaped such that the height of the ribs 611 increases toward the distal end of the hinged-cover inner-wall member 1010. This shape allows, when pulling out the waste toner bottle 70 mounted on the copier 500, the bottom surface of the waste toner bottle 70 to be supported on distal ends of the ribs 611 and guided to the top surface of the reduced portion 1010*a* of the hinged-cover inner-wall member 1010.

When the hinged front cover 101 of the copier 500 is in the closed state illustrated in FIG. 4, the sound absorbing device 600 of the second implementation example is positioned to face the photoconductor 10 and its nearby elements, such as the developing device 12. The sound absorbing device 600 absorbs sounds, such as rotational sound of the photoconductor 10 and the operating sound of the developing device 12, which can be a noise when leaked to the outside.

If the sound absorbing device 600 is located in the hinged front cover 101, which is an exterior cover operable to open and close, in a layout where the sound absorbing device 600 is arranged near a sound source such as the photoconductor 10 and the developing device 12 of the sound which can be a noise, the sound absorbing device 600 can interfere with insertion/extraction of a detachable component.

However, in the copier 500 of the second implementation example, the hinged-cover inner-wall member 1010 that forms the sound absorbing device 600 includes the reduced portion 1010*a*. The reduced portion 1010*a* prevents interference between the waste toner bottle 70 and the sound absorbing device 600 when the waste toner bottle 70 is mounted/dismounted, thereby achieving the structure free from interference between the sound absorbing device 600 and the waste toner bottle 70 at insertion/extraction of the waste toner bottle 70.

Furthermore, the hinged-cover inner-wall member 1010 included in the copier 500 of the second implementation example includes the guide portion 1010*b* that forms, between itself and the reduced portion 1010*a*, the step that guides insertion/extraction of the waste toner bottle 70 which is the detachable component. As a result, operator's work of inserting/extracting the waste toner bottle 70 involved in mounting/dismounting the waste toner bottle 70 is facilitated.

In the copier 500 of the second implementation example, only a part of the hinged front cover 101 has the double structure made up of the hinged front cover 101 and the hinged-cover inner-wall member 1010. The strength of the hinged front cover 101 is increased at least at the part where the double structure is applied.

Because the hinged front cover 101 is of the vertically-pivotable type to be opened by tilting toward the front, the copier 500 of the second implementation example is capable of supporting, on the hinged front cover 101, the bottom surface of the waste toner bottle 70, which is the detachable component, in the course of being mounted/dismounted as illustrated in FIG. 13. Hence, the copier 500 of the second implementation example is increased in ease of mounting/dismounting a detachable component as compared with an image forming apparatus including a double-door hinged cover on which a detachable component cannot be supported.

The configuration including the positioning pin 71 and the positioning hole 72 described in the first implementation example is applicable to the second implementation example as well.

The second implementation example has been described through the example in which the waste toner bottle 70 is the detachable component interference with which is avoided by using the reduced portion 1010*a*; however, the detachable component is not limited thereto. The detachable component can be any component located, in its mounted state, at a lower end portion of an area to be covered by the hinged front cover 101 and mounted/dismounted with the hinged front cover 101 open.

As a method for avoiding interference between the sound absorbing device 600 and a detachable component that is mountable/dismountable with the hinged front cover 101 open, the detachable component may be located at a position considerably higher than the basal end of the hinged front cover 101.

However, the detachable component to be mounted/dismounted with the hinged front cover 101 open is not limited to such a detachable component as the waste toner bottle 70 arranged in a lower end portion of the area to be covered by the hinged front cover 101. Some other detachable components, e.g., the developing device 12 and the photoconductor unit including the photoconductor 10, are arranged at positions considerably higher than the basal end of the hinged front cover 101. Accordingly, if a first detachable component arranged in a lower end portion of the area to be covered by the hinged front cover 101 is relocated to a position considerably higher than the basal end of the hinged front cover 10, the need of relocating a second detachable component arranged at a position higher than the first detachable component to a position higher than the relocated first detachable component arises. As a result, the area to be covered by the hinged front cover 101 expands in the height direction, which undesirably leads to an increase in size of the copier 500 in the height direction.

As another method for avoiding interference between the sound absorbing device 600 arranged in the hinged front cover 101 and the detachable component, the open angle β, which is slightly larger than 90 degrees, of the hinged front cover 101 may be changed to a larger angle which can be 120 degrees, for example.

However, increasing the open angle β of the hinged front cover 101 arises the need of widening clearance between the exterior cover (the recording-paper-cassette exterior cover 61*a*) adjacent to the hinged front cover 101 from below and the hinged front cover 101 to prevent interference between these two exterior covers. However, if this clearance is widened, appearance of the hinged front cover 101 in the operating state or, in other words, in the closed state, can deteriorate.

To avoid this disadvantage, the sound absorbing device 600 included in the copier 500 of the second implementation example includes the reduced portion 1010*a* for preventing interference with a detachable component on the hinged-cover inner-wall member 1010. Furthermore, the hinged-cover inner-wall member 1010 includes the guide portion 1010*b* to form a shape that guides the detachable component on the inner surface (which is the top surface when the hinged front cover 101 is in the open state).

If a detachable component is to be mounted onto a mount position through an opening that is exposed in the side surface of the image forming apparatus (the copier 500) when the hinged front cover 101 is open, it is required to position the detachable component in the lateral and vertical directions while lifting the detachable component, which is difficult.

When in the open state, the hinged front cover 101 projects relative to the copier body 100. Accordingly, the configuration in which the surface (the top surface of the hinged front cover 101 in the open state) of the hinged front cover 101 has the guiding shape is advantageous in that the detachable component can be mounted easily by placing the detachable component on the hinged front cover 101 and inserting the detachable component along the guiding shape.

Figure 16:
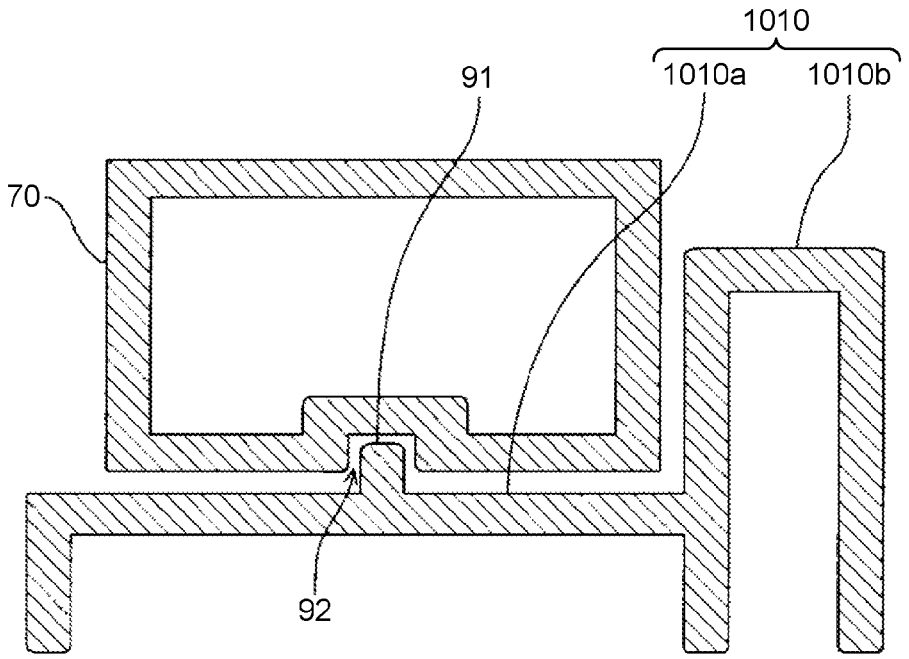
FIG. 16 is a schematic cross-sectional view of an example where a shape that guides the waste toner bottle is formed on the top surface of a reduced portion.

FIG. 16 is a schematic cross-sectional view of an example where a shape that guides the waste toner bottle 70 is formed on the top surface of the reduced portion 1010*a* of the hinged-cover inner-wall member 1010 of the second implementation example.

In the example illustrated in FIG. 16, a guide rib 91 is formed on the top surface of the reduced portion 1010*a* of the hinged-cover inner-wall member 1010; a guide groove 92 is defined in the bottom surface of the waste toner bottle 70.

The example illustrated in FIG. 16 includes, in addition to the configuration where the step is formed on the top surface of the hinged-cover inner-wall member 1010 that forms the Helmholtz resonators, so that the side surface of the guide portion 1010*b* guides insertion/extraction of the waste toner bottle 70, the guide rib 91 and the guide groove 92. With the guide rib 91 engaged in the guide groove 92, the waste toner bottle 70 can be inserted/extracted along the direction in which the guide rib 91 and the guide groove 92 extend.

Combining the configuration that guides the side surface of the waste toner bottle 70, which is the detachable component, along the side surface of the guide portion 1010*b*, and the guide rib 91 and the guide groove 92 as illustrated in FIG. 16 further facilitates operator's work of inserting/extracting the waste toner bottle 70. As a result, ease of use is increased.

Figure 17:
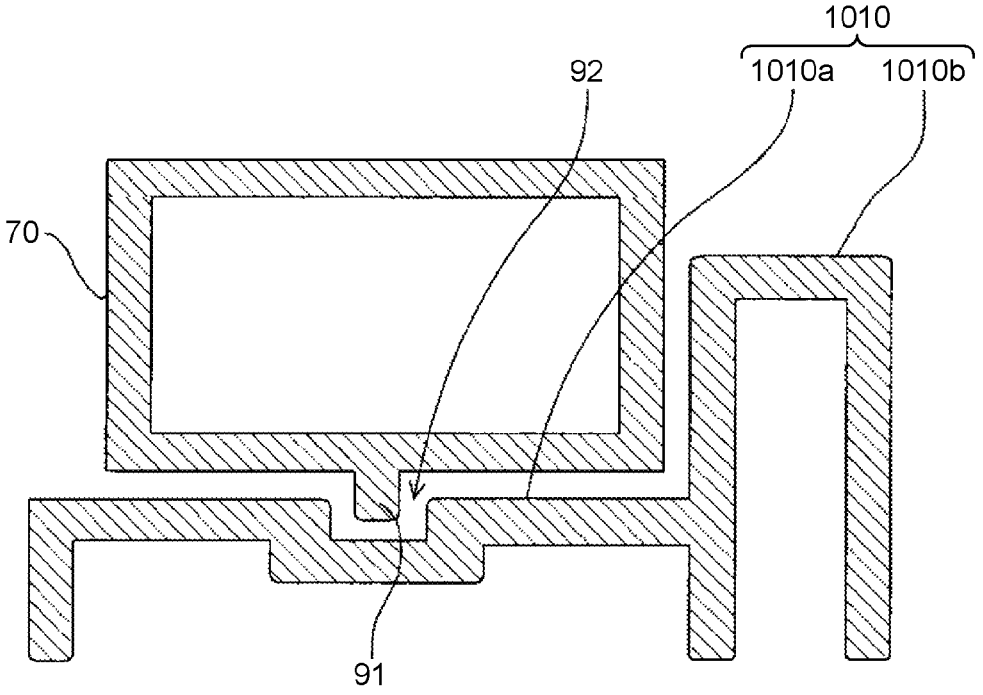
FIG. 17 is a schematic cross-sectional view of another example where a shape that guides the waste toner bottle is formed on the top surface of the reduced portion.

FIG. 17 illustrates a configuration in which the arrangement of the guide rib 91 and the guide groove 92 is reversed from that illustrated in FIG. 16. The guide groove 92 is defined in the top surface of the reduced portion 1010*a* of the hinged-cover inner-wall member 1010; the guide rib 91 is formed on the bottom surface of the waste toner bottle 70.

This configuration illustrated in FIG. 17 can provide an advantage similar to that provided by the configuration illustrated in FIG. 16.

Relationship between the open angle β of the hinged front cover 101 and a tilt of the reduced portion 1010*a* on the hinged-cover inner-wall member 1010 relative to the hinged front cover 101 will be described below.

Figure 18A:
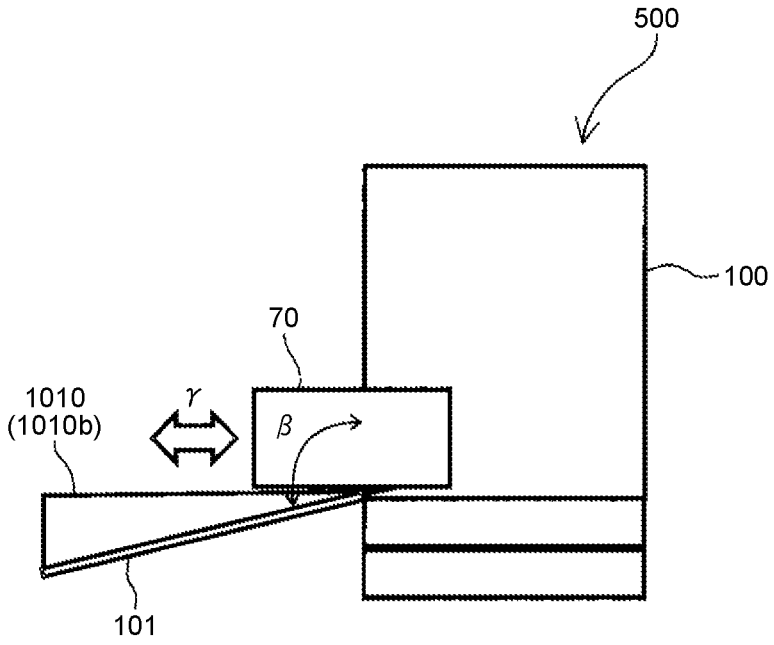
FIGS. 18A and 18B are schematic side views of two types of the copier that differ from each other in open angle, with FIG. 18A being an explanatory diagram of the copier the open angle of which is larger than 90 degrees, FIG. 18B being an explanatory diagram of the copier the open angle of which is smaller than 90 degrees.
Figure 18B:
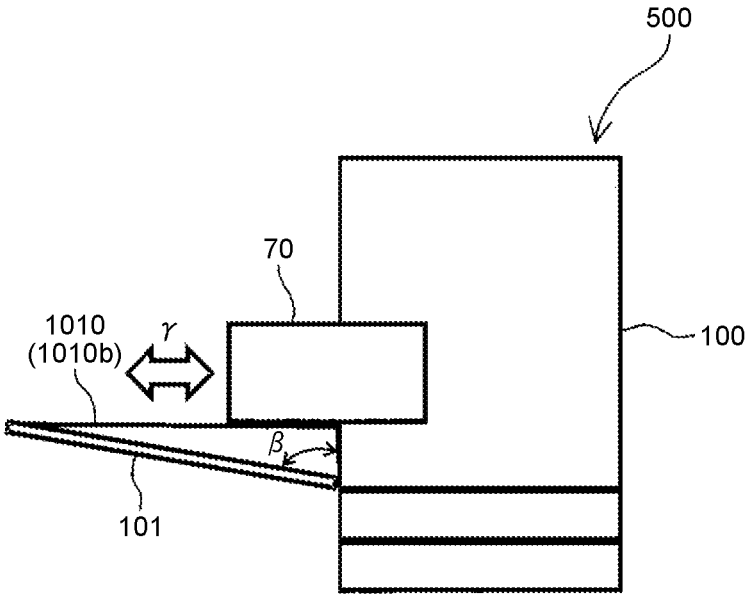

FIGS. 18A and 18B are schematic side views of two types of the copier 500 that differ from each other in the open angle β. FIG. 18A is an explanatory diagram of the copier 500 the open angle β of which is larger than 90 degrees. FIG. 18B is an explanatory diagram of the copier 500 the open angle β of which is smaller than 90 degrees.

The open angle β is an angle between the vertical plane and the inner surface of the hinged front cover 101 in an orientation where the hinged front cover 101 stops pivoting after an operator opening the hinged front cover 101 releases his/her hand therefrom. In the copier 500 according to the embodiment, the inner surface of the hinged front cover 101 in the closed state is paralleled to the vertical plane. Accordingly, the angle through which the hinged front cover 101 can pivot is equal to the open angle β.

When the open angle β is larger than 90 degrees as illustrated in FIG. 18A, the hinged-cover inner-wall member 1010 is tilted relative to the hinged front cover 101 such that the distance between the inner surface of the hinged-cover inner-wall member 1010 and the inner surface of the hinged front cover 101 decreases toward the rotation axis about which the hinged front cover 101 pivots. More specifically, as illustrated in FIG. 18A, in the open state, the hinged-cover inner-wall member 1010 is tilted such that the height of the hinged-cover inner-wall member 1010 relative to the hinged front cover 101 decreases toward the copier body 100 and increases away from the copier body 100. This setting allows the inner surface of the hinged-cover inner-wall member 1010 to be substantially horizontal when the hinged front cover 101 is open. Because the inner surface of the hinged-cover inner-wall member 1010 can function as a guide member when the waste toner bottle 70, which is the detachable component, is mounted/dismounted, the waste toner bottle 70 can be inserted/extracted horizontally as indicated by arrow y in FIG. 18A. In the second implementation example described above, the open angle β is larger than 90 degrees as in FIG. 18A.

When the open angle β is smaller than 90 degrees as in FIG. 18B, the hinged-cover inner-wall member 1010 is tilted relative to the hinged front cover 101 such that the distance between the inner surface of the hinged-cover inner-wall member 1010 and the inner surface of the hinged front cover 101 increases toward the rotation axis. More specifically, as illustrated in FIG. 18B, in the open state, the hinged-cover inner-wall member 1010 is tilted such that the height of the hinged-cover inner-wall member 1010 relative to the hinged front cover 101 increases toward the copier body 100 and decreases away from the copier body 100. This setting allows the inner surface of the hinged-cover inner-wall member 1010 to be substantially horizontal when the hinged front cover 101 is open. Because the inner surface of the hinged-cover inner-wall member 1010 can function as a guide member when the waste toner bottle 70 is mounted/dismounted, the waste toner bottle 70 can be inserted/extracted horizontally as indicated by the arrow y in FIG. 18B.

Either the shapes illustrated in FIG. 16 or those illustrated in FIG. 17 can be employed as a combination of shapes for causing the inner surface of the hinged-cover inner-wall member 1010 to guide the waste toner bottle 70.

Even when the configuration in which the hinged-cover inner-wall member 1010 covers the entire inner surface of the hinged front cover 101 as in the first implementation example is employed, the hinged-cover inner-wall member 1010 may be tilted relative to the hinged front cover 101 depending on the open angle β of the hinged front cover 101. When configured as such, because the inner surface of the hinged-cover inner-wall member 1010 is laid substantially horizontally when exposed by opening the hinged front cover 101, a maintenance tool, a unit for replacement, and the like can be temporarily placed on the inner surface of the hinged-cover inner-wall member 1010.

In the embodiment described above, the part, where the cavities 601 are formed, of the hinged front cover 101 has the double structure. However, the structure of the hinged front cover 101 is not limited to the double structure. The hinged front cover 101 may alternatively have a multiple structure of thriplex or more.

The embodiment described above is merely an example, and each aspect described below of the embodiment provides an advantage(s) specific to the aspect.

In accordance with a first aspect of the embodiment, an image forming apparatus (e.g., the copier 500) includes an apparatus body (the copier body 100), a sound absorbing device (e.g., the sound absorbing device 600) utilizing a Helmholtz resonator, and a hinged exterior cover (e.g., the hinged front cover 101) operable to open and close relative to the apparatus body. The hinged exterior cover is a hinged cover configured to pivot about a pivot shaft (e.g., the hinge) arranged at a lower end portion of the hinged exterior cover. At least a part of the hinged exterior cover has a multi-layer structure made by overlaying a plurality of plate-like members (e.g., the hinged front cover 101 and the hinged-cover inner-wall member 1010) on one another. The sound absorbing device is formed by utilizing space between two plate-like members of the plurality of plate-like members making up the multi-layer structure as a cavity (e.g., the cavities 601) of the Helmholtz resonator.

According to the first aspect, as described above in the embodiment, because the hinged exterior cover has the multi-layer structure in which the plurality of plate-like members are overlaid on one another, the strength of the hinged exterior cover can be increased. Furthermore, forming the sound absorbing device by utilizing the space between the two plate-like members making up the multi-layer structure as the cavity of the Helmholtz resonator, leakage of sound from a surface where the hinged exterior cover is provided of the image forming apparatus can be reduced.

In accordance with a second aspect of the embodiment, in the image forming apparatus of the first aspect, an outer plate-like member (e.g., the hinged front cover 101) of the two plate-like members making up the multi-layer structure includes walls (e.g., the ribs 611) that form side surfaces of the cavity (e.g., the cavities 601).

The second aspect provides the structure in which the cavity of the Helmholtz resonator is formed between the two plate-like members making up the multi-layer structure as described in the first implementation example.

In accordance with a third aspect of the embodiment, in the image forming apparatus of the first aspect, an inner plate-like member (e.g., the hinged-cover inner-wall member 1010) of the two plate-like members making up the multiplex structure includes walls (e.g., the ribs 611) that form side surfaces of the cavity (e.g., the cavities 601).

The third aspect provides the structure in which the cavity of the Helmholtz resonator is formed between the two plate-like members making up the multiplex structure as described in the first implementation example.

In accordance with a fourth aspect of the embodiment, the image forming apparatus of any one of the first through third aspects further includes a positioning unit (e.g., the positioning pin 71 and the positioning hole 72) configured to position the sound absorbing device (e.g., the sound absorbing device 600) relative to the apparatus body.

The fourth aspect allows fixing the sound absorbing device at a desired position relative to a sound source, thereby allowing to obtain a desired sound-absorbing effect as described in the first implementation example.

In accordance with a fifth aspect of the embodiment, the image forming apparatus of any one of the first through fourth aspects further includes a detachable component (e.g., the waste toner bottle 70) configured to be mounted/dismounted on/from the apparatus body with the hinged exterior cover (e.g., the hinged front cover 101) open. An inner plate-like member (e.g., the hinged-cover inner-wall member 1010) of the two plate-like members making up the multi-layer structure includes a reduced portion (e.g., the reduced portion 1010*a*) which is a portion where the distance between the inner plate-like member and an outer plate-like member (e.g., the hinged front cover 101) of the two plate-like members is reduced to avoid a space across which the detachable component is to be inserted/extracted when the detachable component is mounted/dismounted.

The fifth aspect prevents the inner plate-like member from extending through the space across which the detachable component is inserted/extracted when the detachable component is mounted/dismounted, thereby preventing interference between the sound absorbing device (e.g., the sound absorbing device 600) and the detachable component as described in the second implementation example.

In accordance with a sixth aspect of the embodiment, in the image forming apparatus of the fifth aspect, the inner plate-like member (e.g., the hinged-cover inner-wall member 1010) of the two plate-like members making up the multi-layer structure includes a guide portion (e.g., the guide portion 1010*b*). The guide portion forms a step between itself and the reduced portion (e.g., the reduced portion 1010*a*). The step makes sliding contact with a side surface of the detachable component (e.g., the waste toner bottle 70) to guide a direction in which the detachable component is to be inserted/extracted.

The sixth aspect facilitates operator's work of inserting/extracting the detachable component when mounting/dismounting the detachable component as described in the second implementation example.

In accordance with a seventh aspect of the embodiment, in the image forming apparatus of the fifth or sixth aspect, a protrusion (e.g., the guide rib 91) is formed on the top surface of the reduced portion (e.g., the reduced portion 1010*a*), and a guide groove (e.g., the guide groove 92) is defined in the bottom surface of the detachable component (e.g., the waste toner bottle 70). The guide groove is configured to be engaged by the protrusion to thereby define a moving direction of the detachable component relative to the protrusion.

According to the seventh aspect, as described in the second implementation example with reference to FIG. 16, operator's work of inserting/extracting the detachable component with the hinged exterior cover (e.g., the hinged front cover 101) open is further facilitated by use of the protrusion and the guide groove. As a result, ease of use is increased.

In accordance with an eighth aspect of the embodiment, in the image forming apparatus according to the fifth or sixth aspect, a protrusion (e.g., the guide rib 91) is formed on the bottom surface of the detachable component (e.g., the waste toner bottle 70), and a guide groove (e.g., the guide groove 92) is defined in the top surface of the reduced portion (e.g., the reduced portion 1010*a*). The guide groove is configured to be engaged by the protrusion to thereby define a moving direction of the detachable component relative to the apparatus body.

According to the eighth aspect, as described in the second implementation example with reference to FIG. 17, operator's work of inserting/extracting the detachable component with the hinged exterior cover (e.g., the hinged front cover 101) open is further facilitated by use of the protrusion and the guide groove. As a result, ease of use is increased.

In accordance with a ninth aspect of the embodiment, in the image forming apparatus of any one of the first through eighth aspects, an open angle (e.g., the open angle β) of the hinged exterior cover (e.g., the exterior cover) is larger than 90 degrees, and an inner plate-like member (e.g., the hinged-cover inner-wall member 1010), which is an innermost one of the plurality of plate-like members making up the multiplex structure, is tilted relative to an outer plate-like member (e.g., the hinged front cover 101), which is an outermost one of the plurality of plate-like members, such that the distance between the inner plate-like member and the outer plate-like member decreases toward the pivot shaft (e.g., the hinge).

According to the ninth aspect, as described in the embodiment with reference to FIG. 18A, the inner surface of the inner plate-like member can be oriented substantially horizontally when the outer plate-like member is open, so that the detachable component (e.g., the waste toner bottle 70) is inserted/extracted horizontally.

In accordance with a tenth aspect of the embodiment, in the image forming apparatus of any one of the first through eighth aspects, an open angle (e.g., the open angle β) of the hinged exterior cover (e.g., the exterior cover) is smaller than 90 degrees, and an inner plate-like member (e.g., the hinged-cover inner-wall member 1010), which is an innermost one of the plurality of plate-like members making up the multiplex structure, is tilted relative to an outer plate-like member (e.g., the hinged front cover 101), which is an outermost one of the plurality of plate-like members, such that the distance between the inner plate-like member and the outer plate-like member increases toward the pivot shaft (e.g., the hinge).

According to the tenth aspect, as described in the embodiment with reference to FIG. 18B, the inner surface of the inner plate-like member can be oriented substantially horizontally when the outer plate-like member is open, so that the detachable component (e.g., the waste toner bottle 70) is inserted/extracted horizontally.

An aspect of the present invention provides an image forming apparatus capable of reducing leakage of sound from a side surface, in which a vertically-pivotable hinged exterior cover configured to pivot about a pivot shaft arranged at a lower end portion of the hinged exterior cover is provided, of the image forming apparatus while simultaneously increasing strength of the hinged exterior cover.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an apparatus body;

a sound absorber that includes an opening and a cavity; and an exterior cover that is attached to the apparatus body and is operable about a rotation axis of the exterior cover to open and close relative to the apparatus body, wherein, at least a part of the exterior cover has a multiplex structure made by overlaying a plurality of plate-like members on one another, a space is formed, as the cavity, between two plate-like members of the plurality of plate-like members making up the multiplex structure, and securing members are respectively arranged to the apparatus body and the exterior cover, the securing members being fixed to each other to maintain the apparatus body and the exterior cover in a closed state when the exterior cover is closed relative to the apparatus body.

2. The image forming apparatus according to claim 1, wherein a positioning member is formed on the exterior cover, the positioning member positioning the exterior cover to the apparatus body when the exterior cover is closed relative to the apparatus body, and the positioning member and the opening are commonly formed on one and the same member.

3. The image forming apparatus according to claim 1, further comprising a detachable component being to be inserted in and extracted from the apparatus body when the exterior cover is opened relative to the apparatus body.

4. The image forming apparatus according to claim 1, wherein the securing members are a magnet and a magnetic member.

5. The image forming apparatus according to claim 4, wherein the rotation axis is attached near one end of the exterior cover, the magnetic member is arranged to the exterior cover at a position near another end opposite to the one end of the exterior cover, and the magnetic member is arranged on the apparatus body at a position facing the magnetic member.

6. The image forming apparatus according to claim 5, wherein the sound absorber is a Helmholtz resonator.

* * * * *